United States Patent [19]

Winquist

[11] 3,989,774

[45] Nov. 2, 1976

[54] DEVICE AT INJECTION NOZZLE

[75] Inventor: Knut Ludvig Winquist, Elmira, N.Y.

[73] Assignee: Clean Air Company Inc. "CASCA", Apartado, Panama

[22] Filed: Jan. 28, 1975

[21] Appl. No.: 544,682

[30] Foreign Application Priority Data

Nov. 25, 1974 Sweden ..... 147653

[52] U.S. Cl. ..... 261/50 A

[51] Int. Cl.[2] ..... F02M 7/22

[58] Field of Search ..... 261/50 A; 74/569

[56] References Cited

UNITED STATES PATENTS

| | | | |
|---|---|---|---|
| 918,607 | 4/1909 | Sturges | 261/50 A |
| 1,651,402 | 12/1927 | Midgley | 74/569 |
| 3,263,974 | 8/1966 | Braun et al. | 261/50 A |
| 3,278,173 | 10/1966 | Cook et al. | 261/50 A |
| 3,281,132 | 10/1966 | Barnes | 261/50 A |
| 3,298,335 | 1/1967 | De Castelet | 261/69 R |
| 3,342,462 | 9/1967 | Mick | 261/50 A |
| 3,392,965 | 7/1968 | Harrison | 261/50 A |
| 3,720,403 | 3/1973 | Winquist et al. | 261/50 A |
| 3,800,769 | 4/1974 | Graffman | 261/50 A |
| 3,887,663 | 6/1975 | Gural | 261/50 A |

*Primary Examiner*—Tim R. Miles
*Assistant Examiner*—Gregory N. Clements
*Attorney, Agent, or Firm*—Stevens, Davis, Miller & Mosher

[57] ABSTRACT

An injection carburetor device for adjusting the fuel-air ratio which includes an injection nozzle, a valve body seatable in the nozzle, a first sensing member which senses the velocity of the air passing through the carburetor and connected to the valve body through a linkage which is comprised of a rocker arm and cam surfaces capable of being abutted by the free end of the rocker arm and a second sensing member which senses the pressure in the induction pipe of the engine to which the carburetor is attached. The second sensing member moves the free end of the rocker arm laterally to have its other end contact one of the cam surfaces.

2 Claims, 4 Drawing Figures

DEVICE AT INJECTION NOZZLE

This invention relates to injection carburetor where the fuel is injected through a nozzle disposed within the carburetor housing, in such a manner, that a valve body is pressed by a spring means against the nozzle orifice. The amount of injected fuel depends on the spring force, by which the valve body is pressed against said nozzle. When this spring force, by a suitable arrangement, is made responsive to the amount of air passing through the carburetor, it is possible to produce for such an injection carburator a fuel-air mixture adapted for its purpose. Injection carburetors of this kind are known, for example through the patent specifications U.S. Pat. Nos. 3,501,112 and 3,720,403. A further-developed embodiment of such an injection carburetor is shown in a schematic way in the attached drawing.

Figure 1:
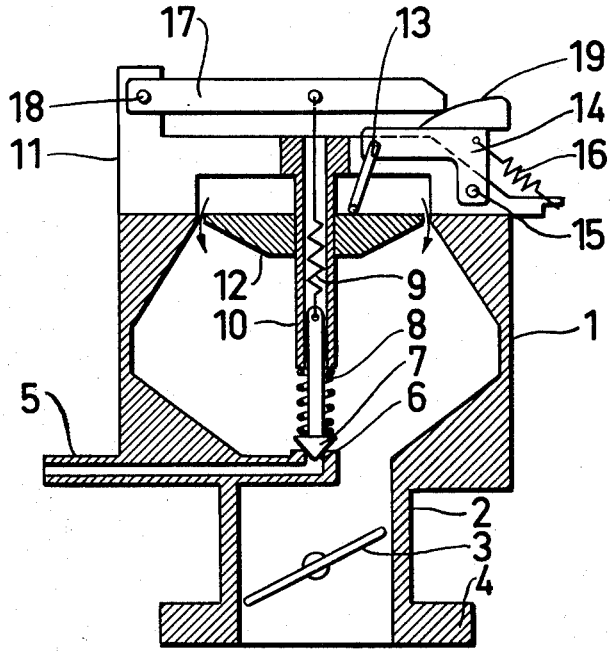
FIG. 1 shows a section through a carburetor of the invention.

The carburetor comprises as main parts a circular carburetor housing 1, the lower portion of which transforms to a circular outlet, which is provided with a throttle 3 of the usual kind and terminates downwardly in a flange 4 for connection to the induction pipe of the engine.

Through a pipe 5 gasoline is supplied under pressure, and the amount of gasoline supplied to the carburetor is restricted by a valve body 7, which by spring force is pressed against the orifice 6 in said nozzle. The said spring force is a resultant of the force from a lower compression spring 8 and the force of an upper tension spring 9. The lastmentioned spring force is continuously adjustable and responsive to the air flow through the carburetor, as appears from the drawing and from the following.

The carburetor housing terminates upwardly in a circular opening, which widens downward to cone shape. In the center of this opening a guide member 10 is rigidly connected to the carburetor housing by means of a bridge 11. There is further provided a control disc 12, which is movable in the conical inlet opening of the carburator housing along said guide member. The control disc is united by a link 13 with an arm 14, which is movable about an axle 15. This axle is supported in the aforesaid bridge 11. The movement of the arm 14 is actuated by a tension spring 16, one end of which is secured in the arm, and the other end of which is secured in the bridge 11. The aforesaid tension spring 9, the lower end of which is secured on the vavle body 7, is secured with its upper end in an arm 17. This arm is movable at one end about an axle 18 supported in the bridge 11, and its other end rests on the surface of a cam 19 secured in the movable arm 14.

When air flows into the carburetor through the annular gap between the control disc 12 and the cone-shaped inlet opening of the carburator, a force is produced which presses the control disc downwards. This force, however, is counteracted by the spring 16 and, thus, by means of the described arrangement the result is obtained, that for each different given amount of air, which passes through the carburator, the control disc 12 assumes a different position corresponding thereto, i.e. a higher position for small amounts of air and a lower position for larger amounts of air. As appears from FIG. 1 and the aforedescribed arrangement, each displacement of the control disc 12 brings about a corresponding displacement, i.e. a rotation about the axle 15 as center, of the cam 19. Due to the tension spring 9 being secured in the arm 17, one end of which, as mentioned before, rests on the surface of the cam 19, this surface can be given such a shape that the tension in the spring 9, and thereby the amount of fuel injected through the nozzle 6, constitutes the tension which is desired for the amount of air passing simultaneously through the carburetor.

For a piston engine of usual kind one usually does not want a carburator or fuel control providing a constant relation between the amounts of fuel and air over the entire working range. It is well familiar to the expert that this relation usually should be such, that for the lower air amounts passing through the carburator a fuel-air mixture should be available which is relatively rich. For somewhat larger air amounts, and further upwardly, a relatively poor mixture is desired, while for the largest air amounts the mixture again should be rich.

Figure 2:
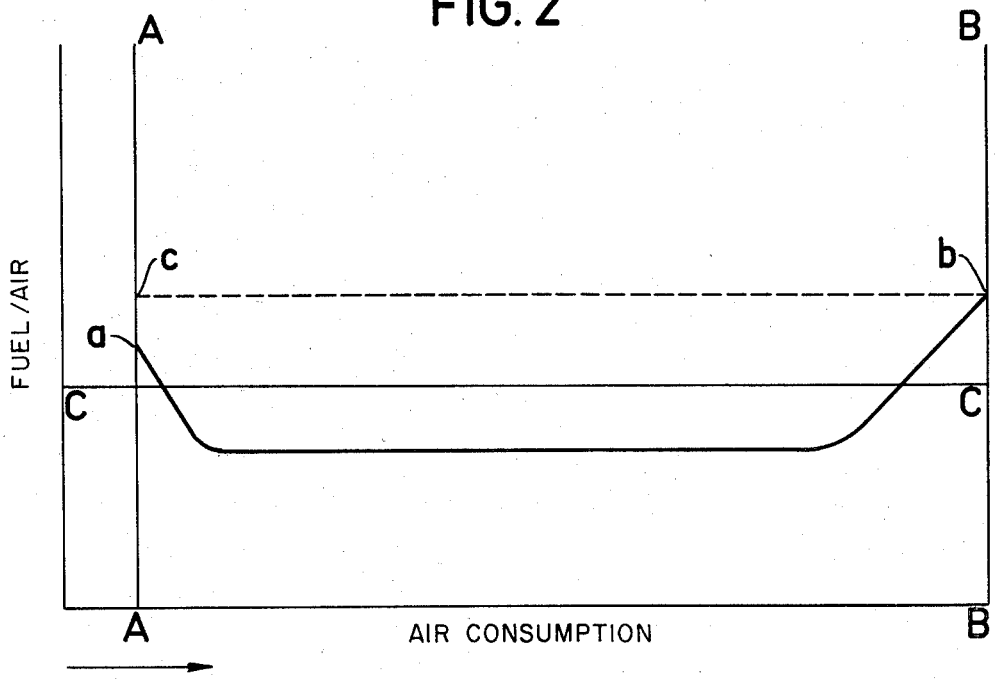
FIG. 2 shows a flow-curve illustrating the properties of the carburetor.

A so-called flow-curve illustrates the properties of the carburetor in this respect, and FIG. 2 shows an example of such a curve. Along the horizontal axis has been plotted the amount of air, which passes through the carburetor, and along the vertical axis has been plotted the ratio F/A, i.e. the ratio between the amount of fuel and the amount of air. The line A—A in the chart represents the air amount required for maintaining the engine, for which the carburetor in question is to be used, running at low number of revolutions, i.e. for idling. The line B—B in the chart represents the maximum air amount which can pass through the carburetor, i.e. at the situation of full throttle and when the circumstances in general render the engine its highest possible number of revolutions. The horizontal line C—C in the chart represents the stoichiometric F/A-ratio. The fully drawn curve is a schematic example of how an engine manufacturer desires the F/A-ratio to vary when the admission of gas successively is increased from idling position — point *a* on the curve — to full throttle — point *b* on the curve — a so-called part throttle curve. The general appearance of the curve is conditioned by circumstances which are well known to the expert, such as that the effect obtained from an engine is higher at a F/A ratio, which is slightly higher than the stoichiometric ratio, while on the other hand the cleanest possible exhaust gases are obtained at a F/A-ratio which is lower than the stoichiometric ratio.

When driving with the engine idling or in a range nearest thereabove, the entire energy supplied through the fuel, or the greater part of said energy, is consumed for overcoming the own inherent energy losses, friction etc. of the engine. This explains why an F/A-ratio somewhat higher than the stoichiometric ratio may be required to render possible a smooth and safe operation of the engine. As the gas throttle is being increasingly opened, the F/A-ratio decreases. This is illustrated in the chart by following the flow-curve from the point *a* in the direction to the right. When the throttle position approaches full throttle, and the passage of air through the carburetor is at maximum, it is again desirable that an increasing part, and finally the entire available effect of the engine can be utilized. This is achieved by the increase in the F/A-ratio, which in the chart is illustrated by the right-hand part of the flow-curve where the point *b* represents an F/A-ratio, which at maximum air passage in the carburetor also permits the engine to develop its maximum effect corresponding thereto.

It should be evident from the afore-described operation of carburetors according to FIG. 1, that by designing the cam surface 19 in a suitable way such an operation of the carburetor can be obtained, that the carburetor delivers a fuel-air mixture with an F/A-ratio according to the flow-curve shown in the chart, or on the whole any reasonable flow-curve which an engine manufacturer can be imagined to desire.

There remains, however, the following problem. When, for one reason or another, the air amount flowing through the carburetor begins to decrease from its maximum value, also the F/A-ratio begins to decrease. This does not imply an inconvenience in the case when the air amount decreases due to less open throttle, because this implies a reduced demand of engine effect. In other words: one can afford to return to the poorer mixture, which produces cleaner exhaust gases. When, however, the decrease of the air amount is caused thereby that the number of revolutions of the engine, in spite of the throttle being maintained wide open, begins to decrease, then it is desired that the possible energy output from the engine is not decreased due to a reduced F/A-ratio. It is, instead, then desired to maintain the F/A-ratio, which for the air amount in question renders it possible for the engine to develop its higher effect corresponding to maximum effect. One example of such a so-called full throttle curve is illustrated by the dashed line from the point *b* to the point *c* in the chart. The full throttle curve, as can be seen, indicates a constant F/A-ratio over the entire working range of the carburetor. This, however, must not be understood such as to always constitute a requirement by an engine manufacturer. Both the part throttle curve and the full throttle curve may very well have a different appearance and a different position in relation to the line indicating the stoichiometric F/A-ratio. Generally, however, the full throttle curve should indicate a higher F/A-ratio than the part throttle curve. A great number of more or less similar solutions of said problems are described in detail in the literature on this subject. All constructions heretofore known, however, show one or more essential disadvantages, such as complicated design and unreliable operation, and in no case has any conventional carburetor succeeded in producing both a part throttle curve and a full throttle curve with accurately that appearance, which an engine manufacturer would state as his ideal requirement on a certain engine.

The present invention eliminates not only the aforesaid shortcomings, but also another problem, viz. to bring about the increase in the F/A-ratio which is required at a sudden increase in the energy output from the engine. It should be generally known that the dominating conventional method of coping with this problem for the carburetor is to provide the carburetor with a so-called acceleration pump, which operates in such a manner, that upon sudden opening of the throttle, i.e. upon rapidly depressing the accelerator pedal to its lowermost position, a spring is released which hereby is permitted to press down a pump piston, which in its turn pumps an additional amount of gasoline into the carburator. It can easily be understood that, although the system works somewhat reasonably in practice, the methodology is far from being ideal and involves essential disadvantages. As an example may be mentioned that, irrespective of the circumstances under which the engine is operating at the moment when such a sudden acceleration is actuated, the additional amount per time unit which is added by the acceleration pump, is always the same. This implies that this amount under certain conditions may be unnecessarily great and under other conditions it may be too small.

Figure 3:
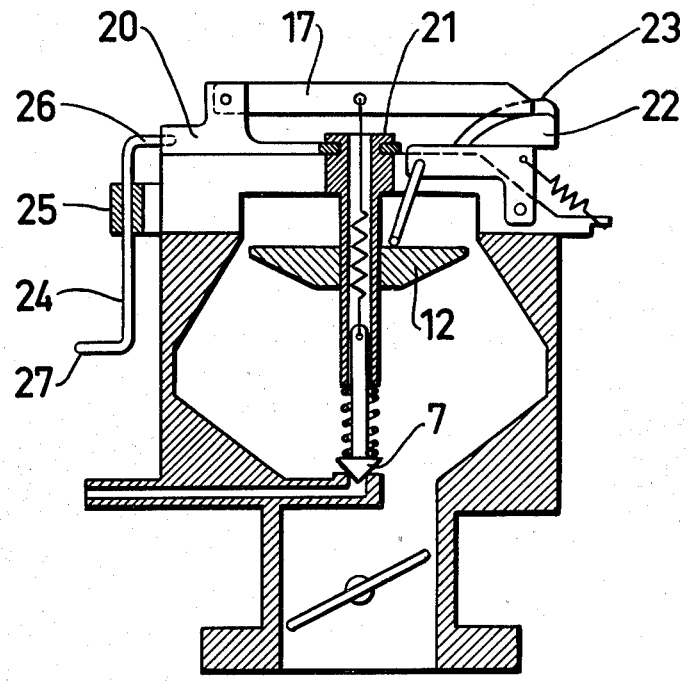
FIGS. 3 and 4 illustrate a modified carburetor construction with two cam surfaces of different shape.
Figure 4:
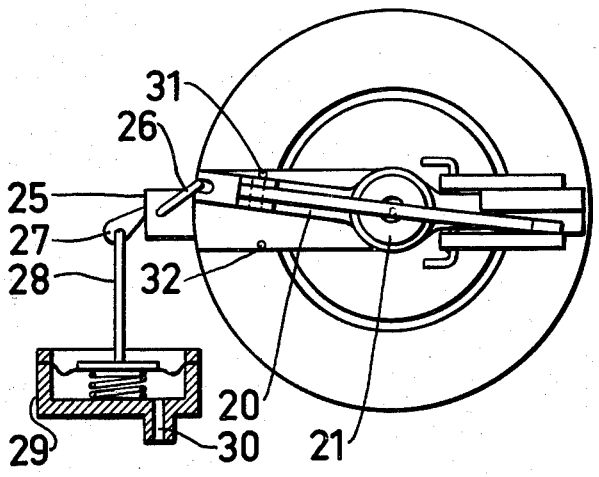

The present invention is illustrated in the accompanying FIGS. 3 and 4 and acts as will be apparent from the following description.

The components 1–18 comprised in the carburetor and their function are the same as described above in conjunction with FIG. 1. According to FIG. 3, the arm 17, as described previously, is movable at one end about an axle 18, but this axle is, as distinguished from previously, fastened in an arm 20, which in its turn is supported about an extension 21 of the upper portion of the pipe 9. The arm 17, as a result thereof, can be turned so that its free end rests either on the one 22 or on the other 23 of two cam surfaces of different shape. An arm 24 is rotatably supported in a sleeve 25 in the bridge 11. The end 26 of the arm 24 is connected to the arm 20, and the other end 27 of the arm 24 is connected to a link 28, which in its turn is connected to a member 29, for example a spring-loaded diaphragm, which via a passageway 30 and pipe (not shown) senses the pressure in the induction pipe of the engine. Said member is so adjusted that upon pressure drop in the induction pipe below a certain level the arm 24 is so turned, that its end 26 actuates the arm 20 so as to be turned in clockwise direction through as long a distance as permitted by a stop shoulder 31. In this position, which is shown in FIG. 4, a relatively low pressure prevails in the induction pipe, and the free end of the arm 17 rests on the cam surface 22, which produces a, relatively seen, lower F/A-ratio. At full throttle, and thus also at a sudden change from a less to a more open throttle, a substantially higher pressure prevails in the induction pipe. When this higher pressure is sensed by the member 29, then the link 28, the arm 24 and the arm 20 are actuated in due succession, so that this latter arm is turned in anti-clockwise direction against a stop shoulder 32. The free end of the arm 17 then is moved over to and rests on the cam surface 23, which is shaped so as to render a higher F/A-ratio. The cam surface 22 in FIGS. 3 and 4 has its correspondence in the cam surface 19 in FIG. 1 and, thus, can be adjusted so that the carburetor can deliver a part throttle curve, which was described above in conjunction with the chart in FIG. 2.

The cam surface 23 may without greater difficulty be shaped so that a full throttle curve with substantially any reasonable appearance can be obtained. At the embodiment shown, the arm 17 is moved laterally, but alternatively the cam surface can be arranged to be movable in lateral direction. The cam surface, further, may alternatively be positioned on the free end of the arm 17 instead of on the arm 14.

What I claim is:

1. A device for adjusting the fuel-air ratio of injection carburetors comprising an injection nozzle, a valve body seatable within said nozzle and movable relative thereto to determine the amount of injected fuel, a rocker arm pivotable at one end and connected intermediate its ends to said valve body, a cam surface abutting the free end of said rocker arm, said cam surface defining a plurality of adjacent cam courses of different shape, said cam surface and said free end of said rocker arm being relatively movable laterally so that all the cam courses are independently contactable by said rocker arm end, a pressure sensing member which senses the velocity of the air passing through the carburetor, said member being connected to the valve body via the cam surface and rocker arm and a sensing means which senses the pressure in the induction pipe of the engine to which the carburetor is attached, said lateral movement being actuated by said means.

2. The device according to claim 1, including an arm on said rocker arm, said arm being rotatably transverse to the extension of the cam courses, the center of rotation of said rocker arm being aligned with the longitudinal axis of the valve body and the arm for effecting the rotation is coupled with said pressure-sensing means.

* * * * *